United States Patent [19]

Kolb

[11] 4,200,086

[45] Apr. 29, 1980

[54] WOOD BURNING STOVE AND FIREPLACE

[75] Inventor: Robert C. Kolb, Spring City, Pa.

[73] Assignee: Valley Forge Stove Co., Spring City, Pa.

[21] Appl. No.: 889,088

[22] Filed: Mar. 22, 1978

[51] Int. Cl.[2] ..... F24B 3/00

[52] U.S. Cl. ..... 126/66; 126/61; 126/77; 165/DIG. 2

[58] Field of Search ..... 126/66, 67, 83, 77, 126/110, 5, 313, 369.3, 350 B; 165/DIG. 2, 73–75, 122 R

[56] References Cited

U.S. PATENT DOCUMENTS

| | | | |
|---|---|---|---|
| 2,439,972 | 4/1948 | Gamblin | 126/67 |
| 2,467,577 | 4/1949 | Baldwin | 126/67 |
| 3,509,867 | 5/1970 | Brosens et al. | 126/83 |
| 4,050,441 | 9/1977 | Horwinski | 126/66 |
| 4,085,725 | 4/1978 | Mesenbrink | 126/67 |

*Primary Examiner*—Samuel Scott
*Assistant Examiner*—Wesley S. Ratliff, Jr.
*Attorney, Agent, or Firm*—Michael F. Petock

[57] ABSTRACT

A wood burning stove, a free standing fireplace or fireplace insert is constructed to receive one of three possible types of inserts to make the unit adaptable to a convection, hot air or hot water heating system. The wood or like fuel combustion rate is automatically controlled by a temperature sensor and draft control system. The insert may be a baffle structure, an air to air heat exchanger or an air to water heat exchanger.

22 Claims, 9 Drawing Figures

WOOD BURNING STOVE AND FIREPLACE

BACKGROUND OF THE INVENTION

The present invention is directed to stoves, free standing fireplaces and fireplace inserts for burning wood and similar combustible materials. More particularly, the present invention is directed to these types of heating units which may be used by themselves as convection or hot air heaters, or as supplementary heaters to an existing hot air or hot water heating system.

Wood burning stoves and fireplaces are well known in the prior art. However, today most residences and other buildings are heated by a hot air or hot water system by the combustion of gas, oil or coal. There is also a substantial use of electrical convection heating. The cost of present day conventional fuels such as gas, oil and coal has risen dramatically. The cost of electricity has also increased dramatically. There has been a need to produce an efficient controllable wood burning stove which may be used to substantially reduce the reliance on gas, oil, coal and electricity as a source of heat. In many parts of the country, wood is available at reasonable costs, and not infrequently at no substantial cost.

SUMMARY OF THE INVENTION

The present invention is directed to wood burning stoves, free standing fireplaces and fireplace inserts which may be readily adapted by the use of inserts for use as a convection heater, a hot water heating system or a hot air heating system. The present invention is directed primarily to a wood burning heating unit, although it is understood that the present invention is equally applicable to burning other types of solid materials and it is particularly understood that the term "wood" includes combustible materials such as artificial logs which are presently manufactured from paper materials such as old newspapers.

The present invention is equally applicable to stoves, free standing fireplaces and fireplace inserts. In describing an embodiment of the invention herein, the word stove will be used, but it is understood that the invention is equally applicable to all similar heating apparatus such as stoves, free standing fireplaces and fireplace inserts.

The present invention is directed to a wood burning heating apparatus which is readily adaptable for convection, hot air or hot water heating and is constructed to be connected as a supplemental heat source to an existing hot air or hot water heating system. The wood burning heating apparatus of the present invention is provided with an automatic draft control which prevents overheating and controls the rate of combustion of the wood or other similar fuel.

Briefly, in accordance with the present invention, a heating apparatus is provided for burning wood or the like enclosed in a housing. A combustion chamber is provided in the housing with a flue opening in an upper portion of the housing. Support means is provided for mounting inside of the housing above the combustion chamber and below the flue opening a removable insert structure. The removable insert structure may be a baffle plate, an air-air heat exchanger or an air-water heat exchanger.

The heating apparatus is provided with an air inlet in a lower part of the housing. The air inlet is provided with a controllable closure which is controlled in response to the temperature sensed by a temperature sensor mounted in the vicinity of the removable insert structure. When the temperature sensed by the sensor exceeds a pre-determined value, the controllable closure is closed reducing or eliminating the draft thereby slowing the combustion rate.

The heating apparatus in accordance with the present invention may be provided with a second air inlet in a lower portion of the housing. The second inlet may be provided with a manually operable closure. The second air inlet is connected to a duct which opens in an upper portion of the combustion chamber for supplying heated air to the combustion gases whereby the combustion gases may be more completely burned producing additional heat and cleaner flue gases.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
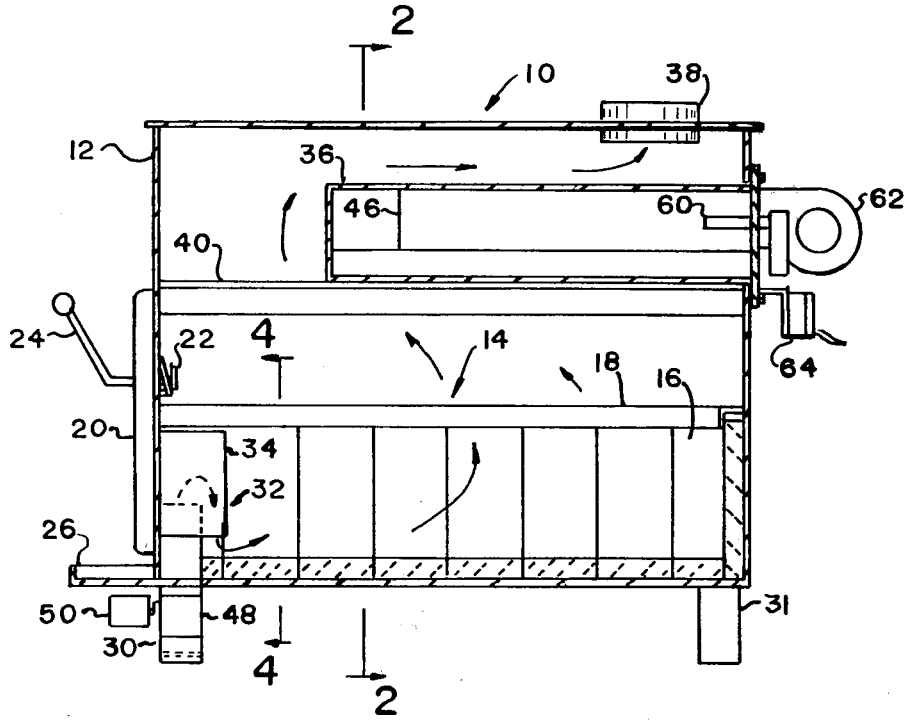
FIG. 1 is a cross-sectional view of a stove in accordance with the present invention taken along line 1—1 of FIG. 2 showing an air-air heat exchanger insert.

Referring now to the drawings, wherein like numerals indicate like elements, there is shown in FIG. 1 a wood burning stove 10 in accordance with the present invention. The stove 10 is provided with a housing 12 which may preferrably be fabricated out of steel plate welded together. The housing 12 contains a combustion chamber 14. A clearer understanding may be had by viewing FIGS. 1 and 2 together. The combustion chamber 14 may be lined with firebrick 16 or other suitable refractory material. The firebrick may be retained in position by suitable brackets 18.

Access to the combustion chamber 14 is provided by means of door 20. An asbestos gasket may be used around the circumference of door 20 to provide a suitable seal in conjunction with tapered cam assembly 22 and door handle 24. A hearth 26 is provided to prevent hot ashes and coals from falling on the floor while loading the stove with fuel such as wood. The hearth 26 may be preferrably constructed of steel and welded to housing 12.

The housing 12 is supported on legs 28–31. Leg 30 forms a part of the draft inlet 32 in the lower part of housing 12. Draft inlet 32 will be described in greater detail in connection with FIG. 4. Draft inlet 32 is provided with a baffle structure 34 which directs the incoming air downwardly and prevents ashes and other materials in combustion chamber 14 from entering the draft inlet 32. The draft air from draft inlet 32 and the combustion gases travel in the direction of the arrows as shown which is basically along the bottom of and up through the combustion chamber, under, around and over insert 36 and out through flue connection 38.

Figure 2:
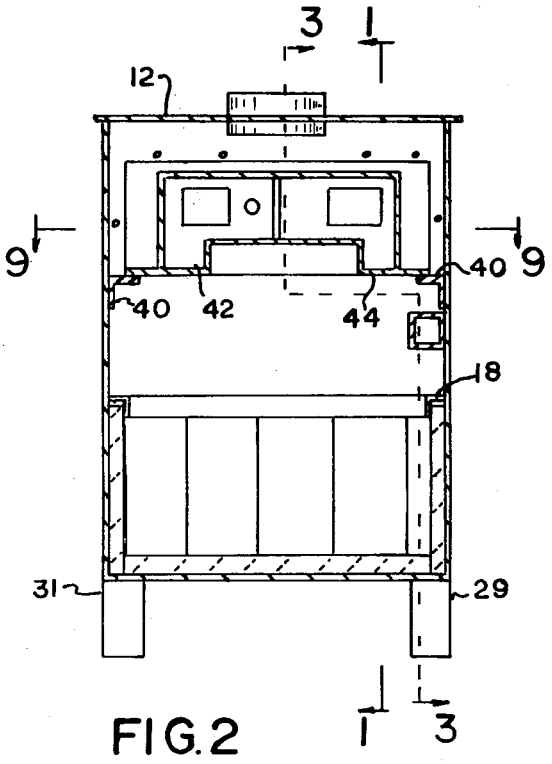
FIG. 2 is a cross-sectional view of a stove in accordance with the present invention taken along line 2—2 of FIG. 1 showing an air-air heat exchanger insert.

Insert 36 as shown in FIGS. 1 and 2 is an air to air heat exchanger. Insert 36 is mounted on supporting means 40. Supporting means 40 may be brackets or angle irons welded to the inner sides of housing 12. However, other suitable means of mounting the inserts will be apparent to those skilled in the art, including obvious variations such as supporting rods extending across the housing and supporting means suspended from the upper element of housing 12.

The air to air heat exchanger insert 36 is comprised of two chambers 42 and 44 separated by a baffle plate 46 which extends over a major portion of the length of insert 36. This forms a "U" shaped circulation pattern as shown in the cross-sectional view of the insert in FIG. 9.

Figure 4:
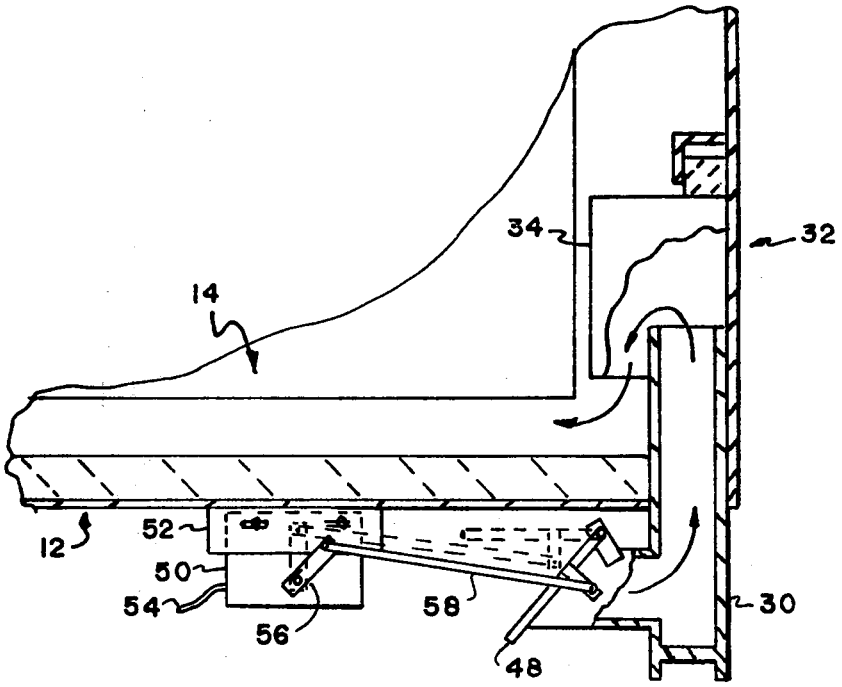
FIG. 4 is an enlarged view of the automatic draft control mechanism taken along line 4—4 of FIG. 1.

The operation of the automatic draft control may be more clearly understood by reference to FIG. 4 in combination with FIG. 1. The draft control 32 is shown enlarged in FIG. 4. Damper or hinged draft control plate 48 is shown in the closed position in solid lines in FIG. 4. A draft control motor 50 is mounted to the bottom of housing 12 by mounting bracket 52. Draft control motor 50 may be operated in response to an electrical signal on electrical line 54 to rotate operator arm 56 counterclockwise as shown in 56 to the dotted line position thereby opening damper 48 by means of connecting rod 58. Although a presently preferred means of operating the damper mechanism 48 has been disclosed, it will be understood by those skilled in the art that other suitable operable damper structures may be used, including, but not limited to reciprocating and screw operated damper means.

When damper 48 is in the open position, the draft or air flow flows as shown by the arrows in FIG. 4 up through leg 30 and down through baffle structure 34 into combustion chamber 14.

Damper 48 is controlled by draft control motor 50 in response to an electrical signal generated by temperature sensor 60. Temperature sensor 60 in FIG. 1 generates an electrical signal to control draft control motor 50 and circulating fan 62. Electrical connection box 64 is provided for the making of the electrical control connections and also includes a 24 volt output transformer to provide the necessary control voltages. Although draft control motor 50 is preferably responsive to temperature sensor 60, it is understood that motor 50 and therefore damper 48 could be controlled by another temperature sensor located elsewhere such as a wall thermostat, particularly in the case where baffle insert 90 may be used.

Temperature sensor 60 provides a signal to turn on fan 62, or in the case of FIG. 3, circulating pump 66, when the sensed temperature rises to a pre-determined setting, such as for example 140° Fahrenheit, and stops the fan 62 or circulating pump 66 when the temperature falls below the pre-determined setting. In addition, temperature sensor 60 provides a signal to control draft control motor 50 and damper 48 in response to the sensed temperature. In one aspect, temperature sensor 60 operates as a limit switch to prevent overheating. For example, when temperature sensor 60 senses a preset upper limit temperature, it causes draft control motor 50 to close damper 48. By way of example, but not by way of limitation, the temperature in the air to air heat exchanger 36 of FIG. 1 may have an upper temperature limit of 300° Fahrenheit and the air to water heat exchanger insert 68 of FIG. 3 may have an upper limit temperature setting of 200° Fahrenheit.

Figure 3:
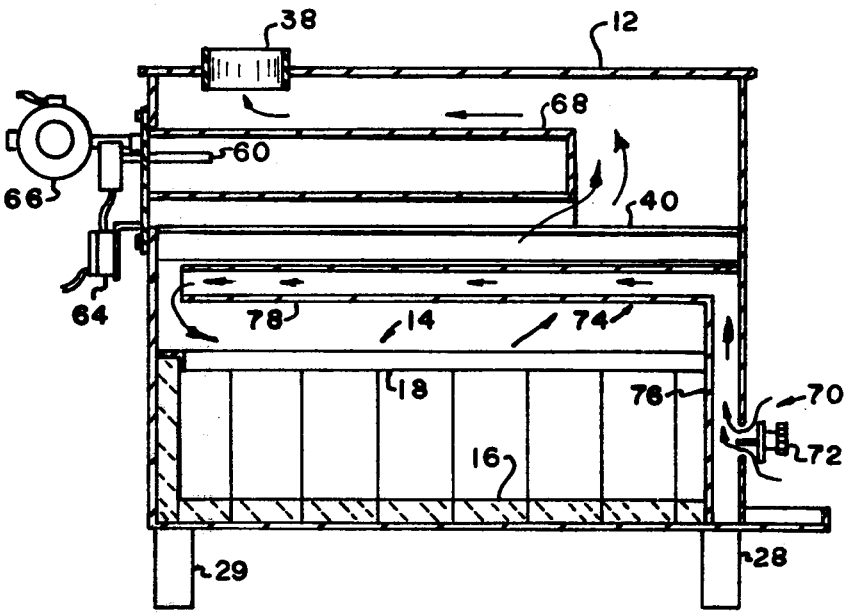
FIG. 3 is a cross-sectional view taken along line 3—3 of FIG. 2, but showing an air-water heat exchanger insert.

Referring now to FIG. 3, which is a cross-sectional view taken along line 3—3 of FIG. 2, there is shown the inner side of housing 12 opposite the one shown in FIG. 1. FIG. 3, as discussed above, shows the air to water heat exchanger 68 with the water circulator or pump 66 mounted at the rear of chamber 44 for structural convenience reasons. FIG. 3 shows a secondary air inlet 70 located in a lower portion of housing 12. Secondary air inlet 70 is provided with a manually operable closure 72. Manually operable closure 72 may be a threaded type closure which is rotated to open or close the inlet. However, it is understood by those skilled in the art that various other suitable types of closures may be used, including but not limited to, slide type and hinged type closures.

Secondary air inlet 70 is in communication with duct 74 comprised of a vertical section 76 and a horizontal section 78. The vertical section 76 of duct 74 is located in combustion chamber 14 and substantial air movement is created by reason of the heated air rising in vertical section 76. Horizontal section 78 guides the air to the rear of combustion chamber 14 where it is mixed with the combustion gases in combustion chamber 14. Secondary air duct 74 provides a metered amount of heated air to the combustion chamber above the burning fuel. The mixing of the pre-heated secondary air with the combustion fumes results in more complete combustion of the combustion gases resulting in more heat from a given amount of fuel and cleaner flue gases. The opening of secondary air inlet 70 in tests has caused the combustion gases above the burning fuel to burst into flame. The closing of secondary air inlet 70 has an opposite effect.

Figure 5:
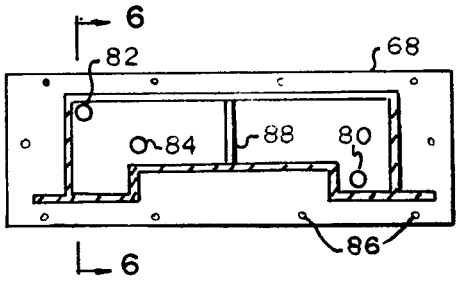
FIG. 5 is a cross-sectional view of an air-water heat exchanger insert taken along line 5—5 of FIG. 6, in accordance with the present invention.
Figure 6:
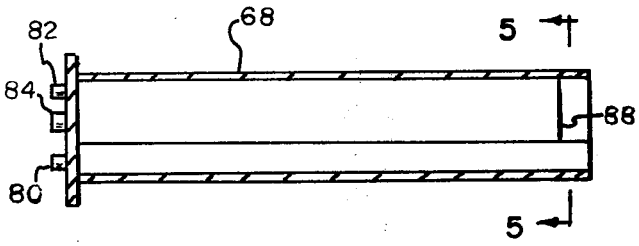
FIG. 6 is a cross-sectional view of an air-water heat exchanger insert in accordance with the present invention taken along line 6—6 of FIG. 5.
Figure 9:
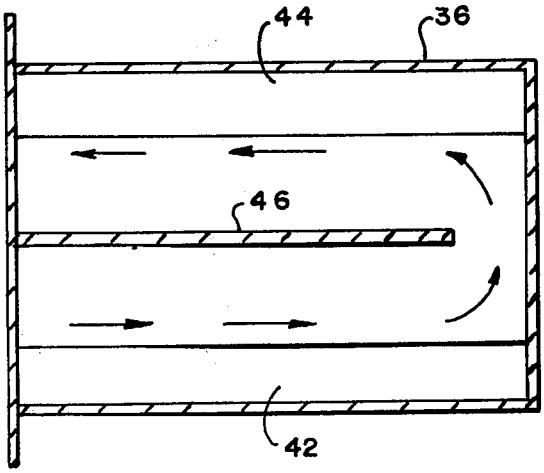
FIG. 9 is a plan cross-sectional view of an air-air heat exchanger in accordance with the present invention taken along line 9—9 of FIG. 2 which shows the air circulation pattern.

Additional cross-sectional views of the air to water heat exchanger 68 are shown in FIGS. 5 and 6. Water inlet connection 80, circulator pump connection 82 and temperature sensor connection 84 are shown. Bolt holes for fastening the air to water heat exchanger insert are shown at 86. Divider plate 88 causes a "U" shaped circulation pattern within the air to water heat exchanger 68 similar to that created in the air to air heat exchanger insert 36 as shown in FIG. 9.

Figure 7:
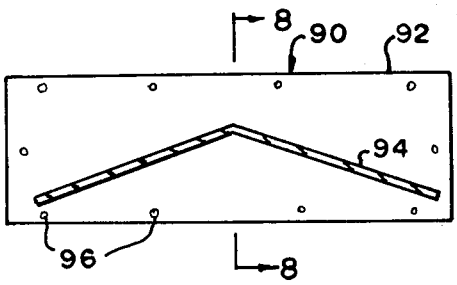
FIG. 7 is an elevation view of a baffle type insert in accordance with the present invention.
Figure 8:
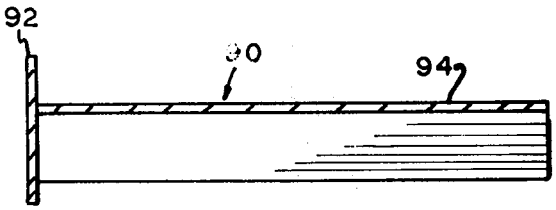
FIG. 8 is a cross-sectional view of a baffle insert in accordance with the present invention taken along line 8—8 of FIG. 7.

Referring now to FIGS. 7 and 8, there is shown a baffle structure insert 90 for insertion into housing 12 when a hot air or hot water circulating system is not desired. Baffle structure insert 90 may be comprised of mounting plate 92 and a generally downwardly facing "V" shaped structure 94 or other suitable downwardly facing concave structure. Insert 90, as well as inserts 68 and 36, are shaped to form a raised central portion and may be constructed of steel or other suitable material not affected by the relatively high temperatures encountered in stoves. The raised central portions may be of any suitable shape, and are not limited to the "V" and rectangular shapes illustrated. Bolt holes 96 are provided for mounting to housing 12.

It will be apparent to those skilled in the art that the present invention embodies the concept of a wood burning stove which may be readily adapted by the use of inserts for use as a convection heater, an air circulating heater or a water circulating heater. It is apparent that the versatile stove of the present invention may be used with its own hot air or hot water circulating system or that it may be connected into existing hot air ducts or existing hot water circulating installations. For example, the stove of the present invention may be connected into the existing hot air ducts of a residence with any additional required heat being provided by the existing heating system. Similarly, in a hot water system, the wood burning stove of the present invention may be used to maintain the water in the heating system hot between on periods of an existing coal, oil or gas furnace. The present invention contemplates an automatically controllable draft system in the wood burning stove, fireplace or fireplace insert and a secondary air system which provides relatively efficient and clean combustion of the wood or similar fuel.

It will be apparent to those skilled in the art that various changes and modifications may be made to the present invention within the spirit and scope of the teachings herein. For example, the structure of the inserts and their mounting above the combustion chamber and below the flue outlet may be varied by those skilled in the art. The shape of the longitudinally extending central cavity or depression in the insert may be varied. The various damper control mechanisms and secondary air control closures may be utilized. All of these variations and modifications are contemplated to be within the scope of the present invention.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A heating apparatus adaptable for use as a convection heater, a hot air heater or a hot water heater for burning wood or the like, comprising: a housing having therein a combustion chamber for combustion of wood or similar solid fuel, a flue opening in an upper portion of said housing, a removable insert structure and support means for mounting said removable insert structure inside of said housing above the combustion chamber and below said flue opening, said removable insert being selected to provide a baffle structure, an air-air heat exchanger having a cavity for circulating air to be heated for use outside of said heating apparatus or an air-water heat exchanger having a cavity for circulating water to be heated for further circulation outside of said heating apparatus, an air inlet in the lower part of said housing for supplying air to the combustion chamber, said air inlet being provided with a controllable closure, said controllable closure being controlled in response to the temperature sensed by a sensor.

2. A heating apparatus in accordance with claim 1 wherein said temperature sensor is mounted in the vicinity of the removable insert structure.

3. A heating apparatus in accordance with claim 2 including a second air inlet in a lower portion of said housing, said second air inlet being provided with a manually operable closure, said second air inlet being in communication with a duct opening in an upper portion of the combustion chamber for supplying heated air to the combustion gases whereby the combustion gases are more completely burned producing additional heat.

4. A heating apparatus in accordance with claim 2 wherein said housing is provided with legs and wherein said air inlet is formed through a hollow section of at least one of said legs to form an air passageway, the upper opening of said hollow log being protected by a baffle structure for downwardly directing the air into the combustion chamber.

5. A heating apparatus in accordance with claim 1 wherein said removable insert structure is constructed to have a raised central portion.

6. A heating apparatus in accordance with claim 1 wherein said combustion chamber is lined with refractory material.

7. A heating apparatus in accordance with claim 3 wherein said duct is provided with a substantially vertical section mounted within said combustion chamber.

8. A heating apparatus in accordance with claim 2 wherein said removable insert structure includes a circulating means controlled in response to the temperature sensed by said sensor mounted in the vicinity of the removable insert structure.

9. A heating apparatus in accordance with claim 8 wherein said circulating means is a fan.

10. A heating apparatus in accordance with claim 8 wherein said circulating means is a pump.

11. A heating apparatus for burning wood or the like comprising a housing having therein a combustion chamber, a flue opening in an upper portion of said housing, support means for mounting inside of said housing above the combustion chamber and below the flue opening a removable insert structure, said removable insert structure having a raised central portion, and draft control means for automatically controlling the draft into the combustion chamber in response to the temperature sensed by a temperature sensor.

12. A heating apparatus in accordance with claim 11 wherein said removable insert structure includes a baffle plate.

13. A heating apparatus in accordance with claim 11 wherein said removable insert structure includes an air to air heat exchanger.

14. A heating apparatus in accordance with claim 11 wherein said removable insert structure includes an air to water heat exchanger.

15. A heating apparatus in accordance with claim 11 including a second air inlet in a lower portion of said housing, said second air inlet being in communication with a duct opening in an upper portion of the combustion chamber for supplying heated air to the combustion gases whereby the combustion gases are more completely burned producing additional heat.

16. A heating apparatus in accordance with claim 11 wherein said automatic draft control includes an air passageway through the bottom of said housing and a baffle structure mounted over said air passageway for downwardly directing the air into the combustion chamber.

17. A heating apparatus in accordance with claim 15 wherein said duct includes a vertical portion mounted within the combustion chamber.

18. A heating apparatus adpatable for use as a convection heater, a hot air heater or a hot water heater for burning wood or the like, comprising: a housing having herein a combustion chamber for combustion of wood or a similar solid fuel, a flue opening in an upper portion of said housing, a selected removable insert structure, the selected removable insert structure being removably mounted inside of said housing above the combustion chamber and below the flue opening, said removable insert structure being selected to be at least one of the group of a baffle plate, air-air heat exchanger or an air-water heat exchanger, an air inlet in a lower part of said housing for supplying air to said combustion chamber, and draft control means mounted on said air inlet for automatically controlling the draft into the combustion chamber in response to the temperature sensed by a temperature sensor, and a second air inlet in a lower portion of said housing, said second air inlet being in communication with a duct, said duct opening in an upper portion of the combustion chamber for supplying air to the combustion gases whereby the combustion gases are more completely burned to produce additional heat.

19. A heating apparatus in accordance with claim 18 wherein said temperature sensor is mounted on said removable insert structure.

20. A heating apparatus in accordance with claim 18 wherein said removable insert structure is selected to be a baffle structure and said temperature sensor is mounted at a location outside of said housing.

21. A heating apparatus in accordance with claim 18 wherein said automatic draft control includes an air passage way through the bottom of said housing and a baffle structure mounted over said air passageway for downwardly directing the air into the combustion chamber.

22. A heating apparatus in accordance with claim 18 wherein said duct includes a vertical portion mounted within the combustion chamber.

* * * * *